US005183436A

United States Patent [19]

Shanley

[11] Patent Number: 5,183,436

[45] Date of Patent: Feb. 2, 1993

[54] FAN FOLDABLE MEMBERSHIP CARD MAILERS

[76] Inventor: Thomas M. Shanley, 19908 NE. 129th St., Woodinville, Wash. 98072

[21] Appl. No.: 863,210

[22] Filed: Apr. 3, 1992

[51] Int. Cl.[5] ..... B42D 15/00

[52] U.S. Cl. ..... 462/6; 462/26; 462/64; 229/69

[58] Field of Search ..... 462/6, 25, 26, 36, 64; 283/904; 229/69

[56] References Cited

U.S. PATENT DOCUMENTS

| | | | |
|---|---|---|---|
| 3,895,576 | 7/1975 | Fischer | 462/64 X |
| 4,887,763 | 12/1989 | Sano | 283/904 X |
| 4,890,862 | 1/1990 | Buchholz | 462/26 X |
| 4,978,146 | 12/1990 | Warther et al. | 283/904 X |
| 5,118,030 | 6/1992 | McNamara et al. | 462/6 X |

*Primary Examiner*—Timothy V. Eley
*Assistant Examiner*—Willmon Fridie Jr.
*Attorney, Agent, or Firm*—Roy E. Mattern, Jr.

[57] ABSTRACT

Manufacturing lines are operated to produce continuously attached membership card mailers, which may be fan folded, and then packaged by a manufacturer, for delivery to an organization. The staff of the organization thereafter, upon demand, complete the entry of information on the continuously attached membership card mailers, then separate them, and thereafter deliver them to respective members. The members in turn remove the inner portion of the paper overlay area of the membership card mailer, along its perforations, exposing their respective membership cards which are then separated from their parent PVC stock by completing the separation previously started by microperforations around the periphery of the membership card.

8 Claims, 5 Drawing Sheets

FAN FOLDABLE MEMBERSHIP CARD MAILERS

BACKGROUND

In the past and currently, plastic membership identification cards for members of organizations such as private clubs, athletic organizations, business associations, Red Cross blood donors, have been provided by manufacturers to these organizations by supplying printed paper materials inclusive of a space to affix a plastic membership identification card, which is first printed, and then adhered in this space. Also these respective printed papers with their respective completed plastic membership identification cards were placed in a complete mailing envelope by the organization for sending to the members.

The times involved, the procedures involved, and the costs involved in supplying organizations with these plastic membership identification cards have been considered excessive enough to consider alternatives.

SUMMARY

Plastic membership identification cards for members of organizations are supplied by a manufacturer to an organization as fan foldable membership card mailers, thereafter to be completed, separated, and delivered to respective members. No separate mailing envelopes are needed.

In an initial manufacturing operation, utilizing rolls of properly sized ten millimeter thick polyvinyl chloride stock, involving a single pass through a production line printing press, produces essentially most of many fan foldable membership card mailers, which include the actual membership card, with its required front and back printing, a printed message on the polyvinyl chloride stock located outside the membership card area, and microperforations on the polyvinyl chloride stock which cuts the membership card to size, while still retaining the membership card being created in the polyvinyl chloride stock as this stock continues to position the many membership card mailers.

These microperforations allow the membership card to be released from its parent polyvinyl chloride stock at a later time by a slight pushing force applied by the member's fingers. This perforation and removal method produces a relatively smooth edged membership card that will not come loose from the parent polyvinyl chloride stock during manufacturing, handling, shipment to the organization, or during impact printing processes undertaken by the staff of the organization.

During that first pass through the press, an NCR type clear "copy coat" matte imprint coating is applied, within a designated area of the membership card being created, which allows the staff of the organization to apply the individual member's name, membership number and expiration date, in that area during an impact printing process.

An additional printing press mounted die is functioning, concurrent with these operations, to produce impact printer, pin feed holes along each edge of the polyvinyl chloride stock. These pin feed holes are utilized during the later automatic motor driven feeding of the membership card mailers, created on the continuous length of the polyvinyl chloride stock, through an impact printer operated by the staff of the organization.

This polyvinyl stock supplied and utilized in roll form for the first pass through the press is, by virtue of the transverse perforations and along the transverse perforations, fan folded into appropriate size stacks for subsequent insertion in a Ga-Vehren "tip-on" machine to receive the paper overlays.

The second manufacturing operation, utilizing rolls of properly sized twenty four pound bond paper stock, involving a single pass through a production line printing press produces, through printing and cutting, the paper overlays which will become affixed to the polyvinyl stock. This paper stock, during its pass through the press, is printed to include the organization's return address and preferably a first class bulk mail postal permit number positioned in accordance with the appearance of a standard mailing envelope. In addition this stock provides a space for the entry of the member's mailing address, which will be positioned directly below the organization's return mailing address. The right side of the stock, in the area normally used for a mailing address, contains a black "block-out" pattern, within which the staff of the organization impact prints the member's membership information. The impact printing within this area, which is directly over the membership card being completed, results in imprinting through the block-out area onto the clear "copy coated" area of the membership card, while providing security of sensitive membership information within the blocked-out area of the paper overlay.

An additional printing press mounted die is functioning, concurrent with the printing operation, to produce the paper overlay from the paper stock, after it receives all imprinting requested by the organization. This paper overlay is severed from its parent paper stock into its finished shape later to be integrated with the polyvinyl stock to produce through that integration the completed fan foldable membership card mailers.

The third and final manufacturing operation, performed on a Ga-Vehren "tip-on" machine, affixes the paper overlay to the polyvinyl stock.

The completed paper overlays arranged in appropriate sized stacks are placed into the Ga-Vehren "tip-on" machine at the proper location or "station" to become machine placed upon the polyvinyl stock running beneath and becoming affixed to the polyvinyl stock through the use of an adhesive.

A fan folded stack of processed polyvinyl stock is mounted in the Ga-Vehren "tip-on" machine and during its operation is pulled through the machine past a machine "station" which applies the adhesive. The adhesive is machine applied to the polyvinyl stock in an area and configuration so as to lie along and around the entire border of the paper overlay when it is applied to the polyvinyl stock, becoming the completed membership card mailer. The overlay, which is preferably a twenty four pound bond paper, becomes, in effect, the equivalent of a front surface of a mailing envelope, which it replaces.

The completed membership card mailer thus produced is, upon exiting the Ga-Vehren "tip-on" machine, fan folded along its transverse perforations into suitably sized stacks for packing and mailing to the organization.

Upon receipt of the membership card mailer, composed of the polyvinyl chloride stock and paper overlay, the member of the organization peels off the paper overlay and pushes the membership card free from the parent polyvinyl chloride material, for its subsequent placement generally in his or her billfold.

The times involved, the procedures involved, and the costs involved in supplying organizations with these plastic membership identification cards have been substantially reduced, by utilizing these manufacturing methods in producing these fan foldable membership card mailers for the subsequent completion and mailing by the staffs of these organizations.

DRAWINGS

A preferred embodiment of the fan foldable membership card mailers is illustrated in the drawings, wherein:

FIG. 1 is a top view of three connected fan foldable membership card mailers, with broken lines indicating they are three of many, which are later fan folded, and with broken lines indicating, on one of these mailers, how the plastic membership card being created from the lower polyvinyl chloride portion of the mailer is positioned below the bond paper overlay portion of the mailer having the block out area, as these mailers are shown to represent those fan foldable membership card mailers sent to an organization by a manufacturer, for subsequent operations, inclusive of an impact printing process, before mailing individual membership card mailers to members, who separate the plastic membership cards from these mailers, utilizing the benefits of the microperforations along the membership card edges;

Figure 1:
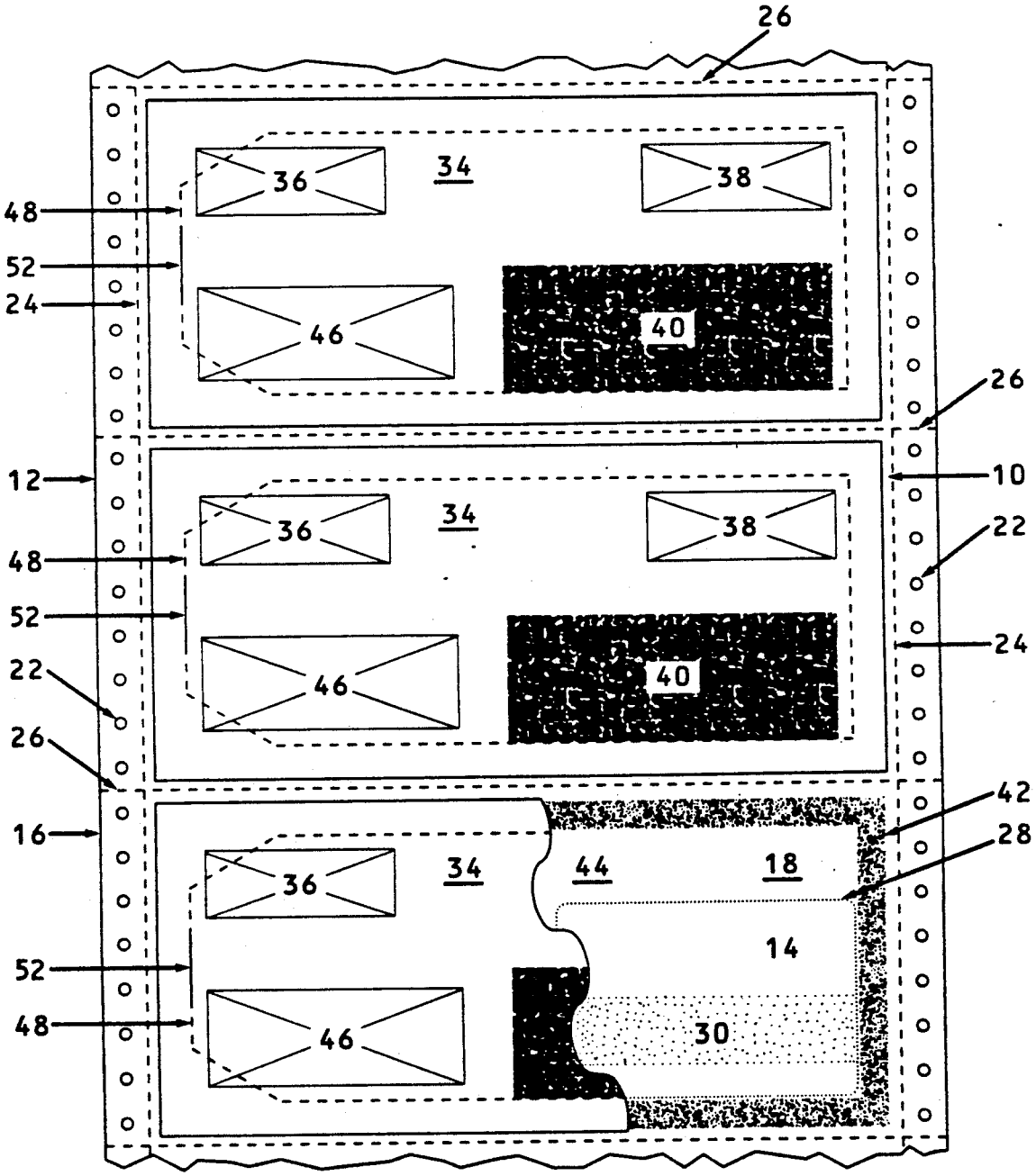
Figure 4:
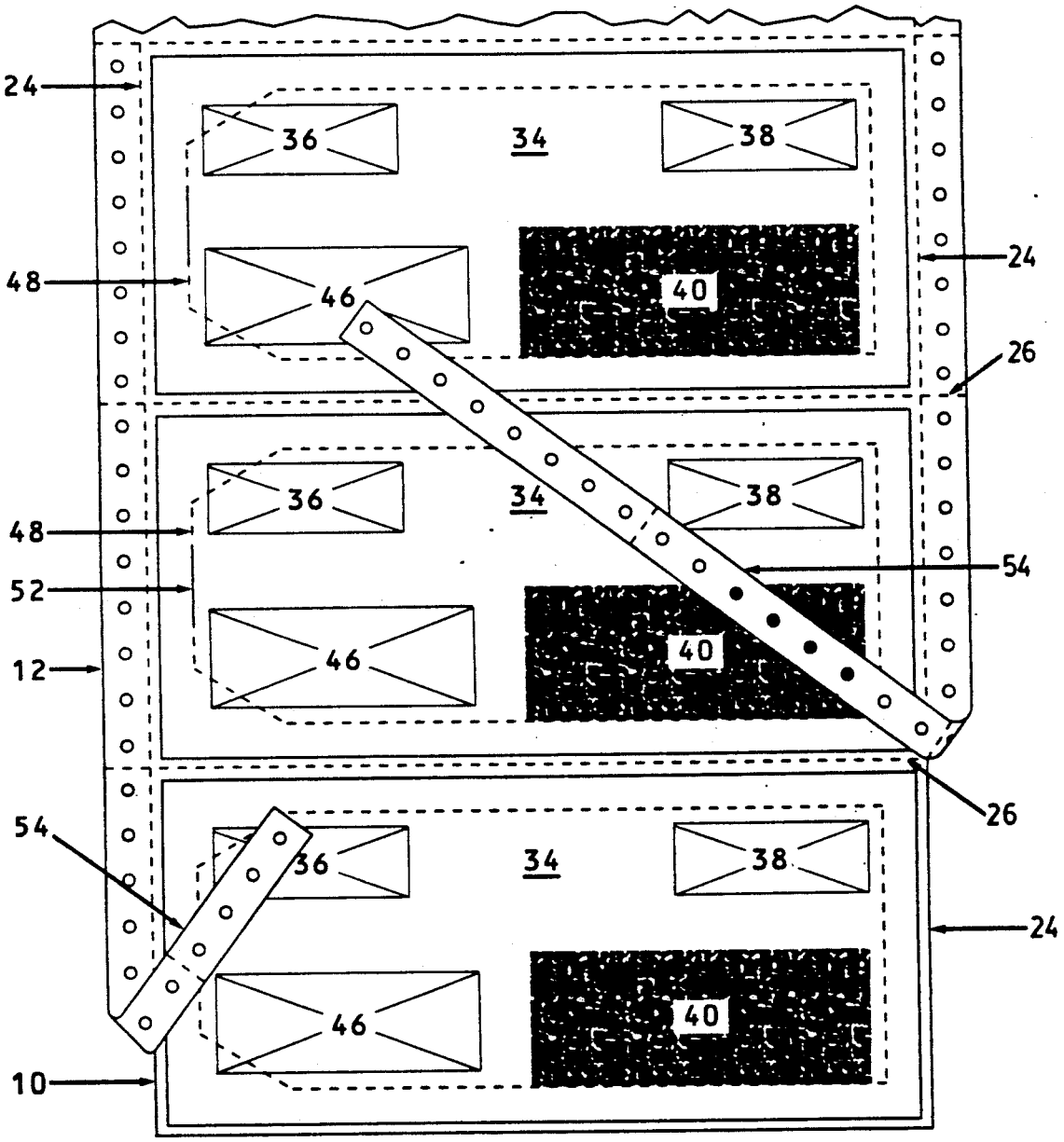
Figure 5:
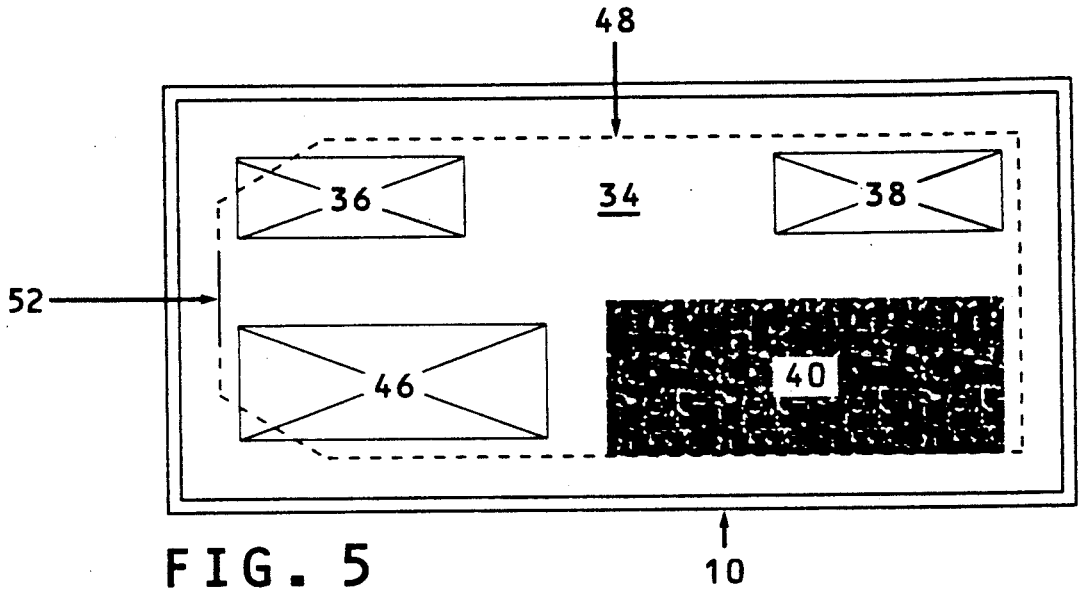
Figure 6:
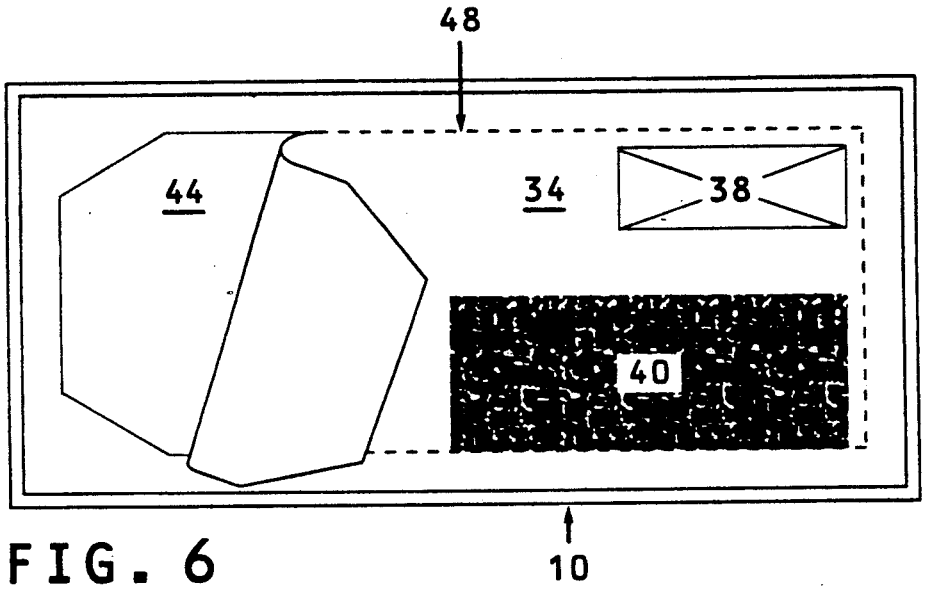
Figure 7:
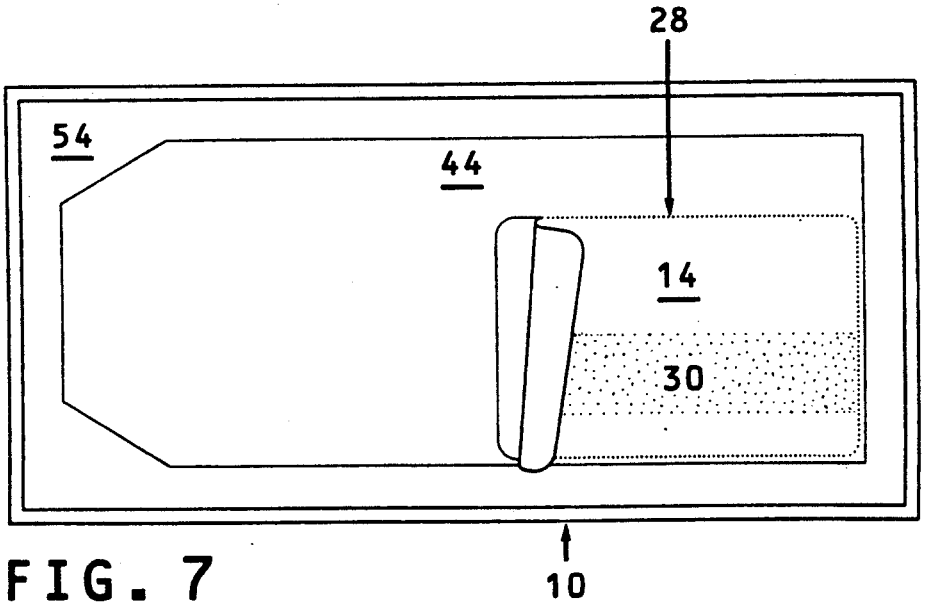

FIG. 4 is a top view, similar to FIG. 1, showing the assembled polyvinyl material or stock, and the paper material or stock, as received at an organization, where the staff members, after printing more information on the fan foldable membership card mailers, separate the individual membership card mailers from the manufactured fan foldable membership card mailers to prepare them for mailing to a member;

FIG. 5 is a top view of the individual membership card mailer, as received by a member of the organization;

FIG. 6 is a top view, similar to FIG. 5, illustrating how the member has used his or her finger and fingers, to pull up on the perforated portion of the paper material, and thereafter to start to peel it clear of the polyvinyl membership card; and FIG. 7 is a top view, similar to FIGS. 5 and 6, illustrating how the member has used his or her fingers to start to push the membership card clear of the balance of the polyvinyl material.

DESCRIPTION OF THE PREFERRED EMBODIMENT

Introduction

Figure 2:
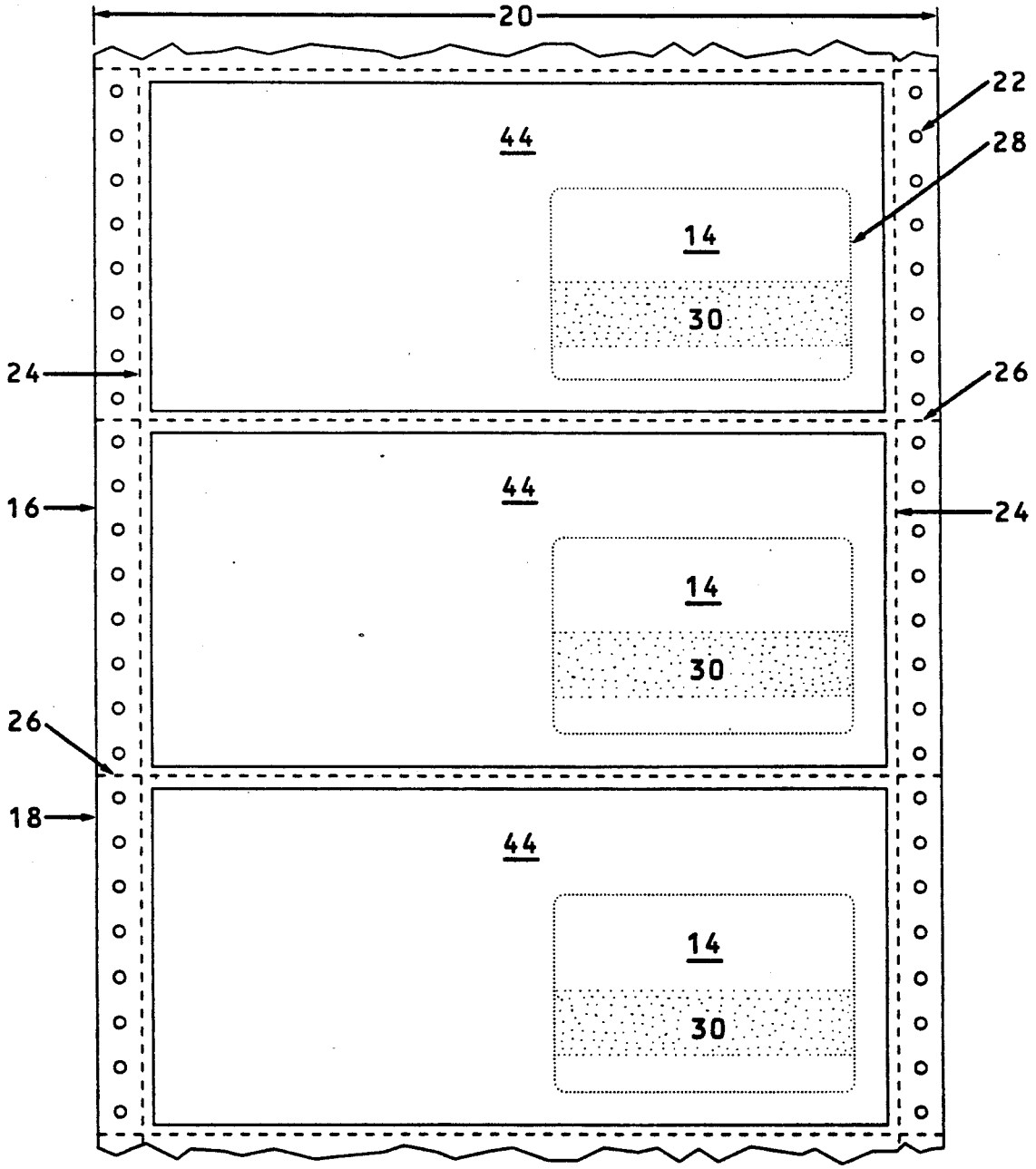
FIG. 2 is a top view of only the polyvinyl material or stock, in reference to FIG. 1, indicating the printing, cutting, and perforating steps undertaken in preparing this polyvinyl material.
Figure 3:
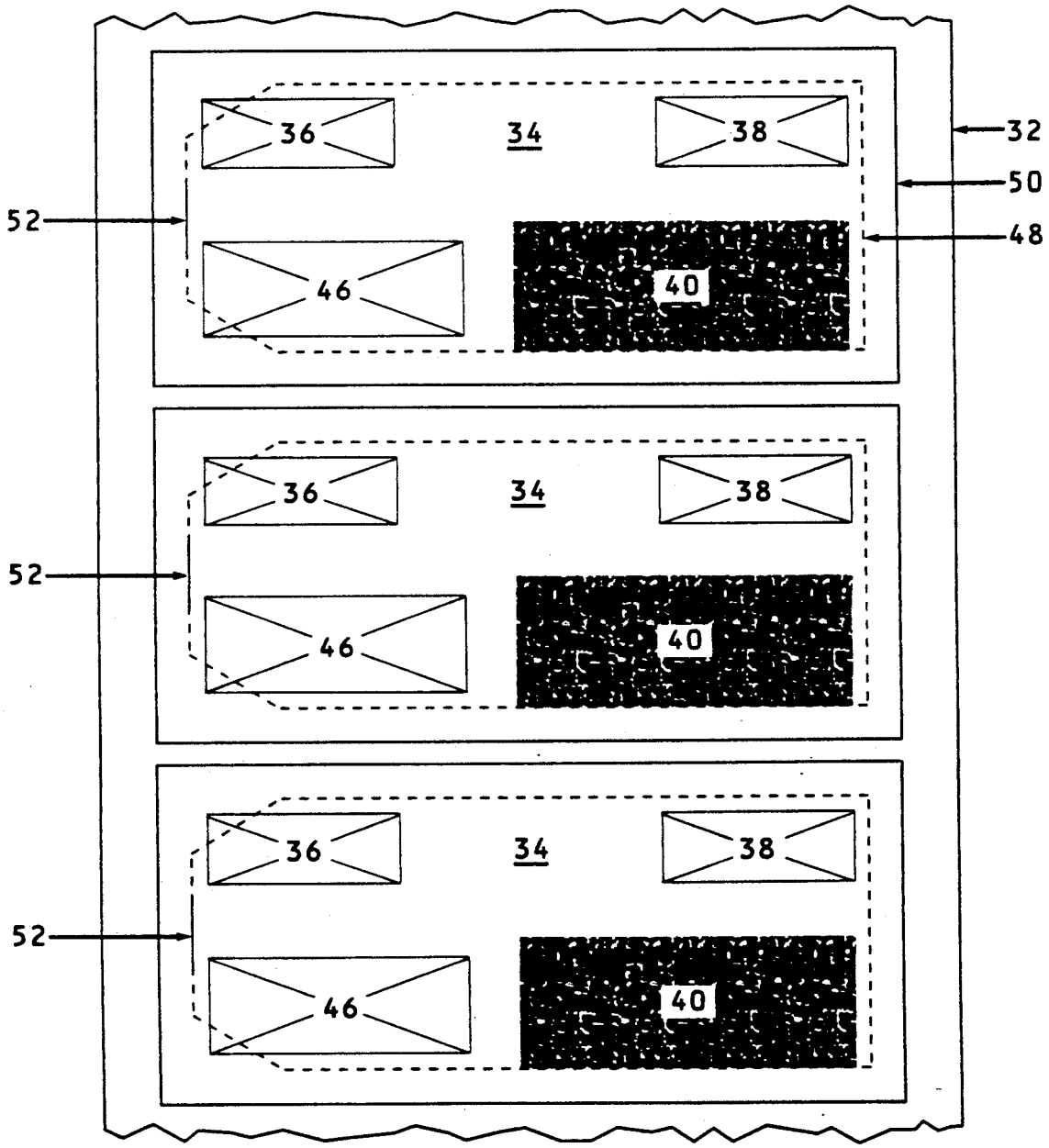
FIG. 3 is a top view of only the paper material or stock, in reference to FIG. 1, indicating the printing, perforating and cutting steps undertaken in preparing this paper material or stock.

The fan foldable membership card mailers 10, as shown in FIG. 1, when manufactured, are an integration of the processed polyvinyl stock taken from a roll 16 and having a width designated by numeral 20, as shown in FIG. 2, and the paper overlays 34 processed from rolls of bond paper, as shown in FIG. 3, are made together with others as an overall fan foldable membership card mailer product run assembly 12, which is preferably fan folded, placed in a shipping container and delivered to an organization. Staff members of the organization complete the membership card mailers 10, and then separate them, as shown in FIG. 4, and deliver them, as they are shown in FIG. 5, to respective members. Upon receipt and review by the member, he or she, via finger manipulations, separates the paper overlay portion 34, from the remainder of the mailer 10, exposing the membership card area 14 of the polyvinyl chloride material 18, as shown in FIG. 6. He or she then pushes his or her membership card 14 to sever perforations and free the card 14 from this mailer 10 for his or her subsequent independent use of the membership card 14, as shown in FIG. 7.

The First Run of a Production Printing Press and Accessories Thereof

As shown in FIG. 2, a roll 16 of polyvinyl chloride material 18, hereinafter referred to as PVC material 18, or plastic material 18, having a designated width, indicated by numeral 20, generally equal to the length of a business envelope, having a length of several hundred feet, and having a thickness providing the rigidity and wearability of a membership card, such as ten millimeters, is first run through a production printing press and related accessories. Many forming and printing operations are undertaken in this first run to start the creation of the fan foldable membership card mailers 10 and their respective integral membership cards 14.

The forming operations are:

1) punching spaced aligned pin feed holes 22 along each side of all the PVC material 18 utilized to produce the fan foldable membership card mailers 10 being created, and these holes 22 are compatible with the driving mechanisms of an impact printer;

2) creating aligned perforations 24 adjacent and parallel to the spaced, aligned pin feed holes 22;

3) creating aligned perforations 26 spaced transversely and extending across the width 20 of the PVC material 18, and perpendicular to the aligned perforations 24, which are adjacent and parallel to the pin feed holes 22;

whereby these perforations 24 and 26 establish the area of each mailer 10 being formed;

4) creating microperforations 28 within the area of each mailer 10 being formed to continue the creation of the membership card 14.

A matte printing operation applies an NCR type clear copy coat matte coating throughout an area 30 on the membership card 14 which is being created.

The printing operations are:

1) printing, optionally using colors, membership card usage instructions on areas of the mailer 10 being created, which are located about the area of the membership card 14 being created, and optionally printing on both sides of the mailer 10 being created; and 2) printing, optionally using colors, membership card information on the membership card 14 being created, and optionally printing on both sides of the membership card being created.

The Second Run of a Production Printing Press and Accessories Thereof

As shown in FIG. 3, a roll 32 of paper, preferably a bond paper, is run through a production printing press to create and to print, as necessary, paper overlays 34 of respective sizes, which are compatible and complementary to the respective membership card mailer sizes, with printing in colors being optional, and with printing on both sides being optional.

This printing run includes printing: the organization's return address 36; preferably the organization's first class bulk mailer postal permit number 38, a black block out area 40, which is to be located over the NCR type clear copy coat matte coating throughout the area 30 on the membership card 14, as shown in FIG. 2, which is being created.

Also perforations 48 are made, within the boundary 50 of the paper overlay. A portion 52 of these perforations 48 being a short continuous cut 52 through the paper overlay provided for the member's ease in the removal of most of the paper overlay, after receipt of his or her individual membership card mailer 10.

The Affixing of the Paper Overlays to the Membership Card Mailer Polyvinyl Portions By operating a Ga-Vehren tip-on machine, borders of adhesive 42 are applied to the polyvinyl stock in an area and configuration compatible with the later positioning of the paper overlays as shown in FIG. 1.

Thereafter, when the paper overlays 34 are affixed to the polyvinyl stock 18 which integrally include the membership card 14 being created, they thereby become, in effect, the equivalent of a front surface of a mailing envelope, which it replaces.

The Preferable Fan Folding of the Continuous Production Run of the Membership Card Mailers The manufacturer, after completing the overlaying and adhering of the paper overlays 34 over the polyvinyl chloride portions 44 of the membership card mailers 10 being created, preferably fan folds the production run assembly 12 into containers for delivery to the organization.

Operations Performed by the Staff of the Organization After Receiving the Fan Folded Membership Card Mailers The staff of the organization, after receiving the fan folded membership card mailers 10, upon demand for membership cards, will operate an impact printer, which compatibly receives the then continuous fan folded membership card mailers 10. In doing so, the member's name and address is printed in the area 46 on the paper overlay 34 below the previously printed return address 36 of the organization, as indicated in FIG. 1. Also by imprinting on, and therefore through, the black block out area 40 on the paper overlay 34, the member's membership information, which is considered private information, is imprinted onto the clear copy coated matte coating 30 of the polyvinyl chloride membership card 14, being created. This completes the information required on the member's membership card 14, while providing the security of the sensitive membership information, below the black blocked out area of the paper overlay 34. As shown in FIG. 4, the staff separates the individual mailers 10 from the pin feed holed borders 54, of the polyvinyl material 18, now to be discarded, by separating the pin feed holed borders along the perforations 24, with the final separation of each membership card mailer from all others being along the transverse perforations 26, and delivers them to the respective members of the organization, generally using postal services.

Operations Performed by the Member Who Receives His or Her Fan Foldable Membership Card Mailer As shown in FIGS. 5, 6, and 7, a member of the organization, upon receipt of his or her membership card mailer 10, as it appears in FIG. 5, removes the paper overlay 34, as shown in FIG. 6, along its perforations 48, starting at the area of those perforations which contains a short continuous cut 52 or slit 52, as shown in FIG. 5, of sufficient length to insert his or her fingernail. This cut 52 is provided for ease in starting the paper overlay removal operation, thus exposing the polyvinyl stock 44 with its integral membership card 14. The member, then using his or her fingers, applies reasonably gentle forces to push the polyvinyl chloride membership card 14 clear of the remaining polyvinyl chloride portions 54 of the membership card mailer 10, by taking advantage of the previously created microperforations 28 as shown in FIG. 7. The resulting freed membership card 14 has reasonably smooth edges, and is ready for use by the member.

I claim:

1. Fan foldable membership card mailers as supplied by a manufacturer to an organization, thereafter to be completed, separated, and delivered to respective members of the organization, comprising:

a. a roll of polyvinyl chloride stock of a designated width and designated length, having in turn:
   i. pin feed spaced holes along both edges of this roll;
   ii. perforations adjacent and parallel to the pin feed spaced holes along both edges of the initial roll;
   iii. Perforations spaced transversely on this roll and extending between the perforations, which are adjacent and parallel to the pin feed spaced holes, and extending beyond them across the polyvinyl chloride stock, thereby determining the size of each membership card mailer;
   iv. microperforations arranged in the direction of the length of this roll and in the transverse direction across this roll, within the perforated size of each membership card mailer, thereby determining the size of each membership card being created;
   v. an N.C.R. type clear copy matte coating in a rectangular shape area at a selected location on each membership card being created; and
   vi. printing on each membership card mailer of this polyvinyl chloride stock roll which: sets forth membership card usage instructions which are spaced about the area of the membership card being created; and sets forth membership card text, design, and logo on the area of the membership card being created;

b. multiple overlay of paper stock, each one of the overlays serving as a cover for each membership card mailer and adhered to the polyvinyl chloride stock about their complementary borders by an adhesive, having in turn:
   i. a printed blackout area located over the N.C.R. type clear copy matte coating on each membership card being created;
   ii. a printed return address of the organization;
   iii. a space for necessary postage such as a printed first class bulk mailer postal permit number of the organization, which may be printed in this space;

iv. a space for the subsequent use by the organization to enter the name and address of the member of the organization; and at this subsequent entry time, the member's name, member's membership number, and expiration date of the respective membership, will be imprinted by impact printing in the blackout area, resulting in printing on the polyvinyl material of the membership card being created, where the N.C.R. type clear copy matte coating has been previously distributed to receive this membership data, and this private data will therefore not be viewed by any persons during the sending functions, which are often mailing services, of this membership card mailer from the organization to a member thereof.

2. Fan foldable membership card mailers, as supplied by a manufacturer to an organization, as claimed in claim 1, wherein the printing is also undertaken on the opposite side of the membership card mailer polyvinyl chloride stock which sets forth additional membership card usage instructions.

3. Fan foldable membership card mailers, as supplied by a manufacturer to an organization, as claimed in claim 1, wherein the printing is also undertaken on the opposite side of the membership card being created in the membership card mailer, in reference to general, not private, information, which will be later referred to from time to time by the member to whom the completed membership card was specifically delivered for his or her use.

4. Fan foldable membership card mailers, as supplied by a manufacturer to an organization, as claimed in claim 3, wherein the printing is also undertaken on the opposite side of the membership card mailer in areas surrounding the membership card being created.

5. Fan foldable membership card mailers, as supplied by a manufacturer to an organization, as claimed in claim 1, wherein the multiple overlay of paper stock, in reference to each one of the overlays has an arrangement of perforations including a short continuous cut, which are subsequently used by a member when he or she is removing most of the overlay to reach the membership card.

6. A method of making fan foldable membership card mailers, as supplied by a manufacturer to an organization, thereafter to be completed, separated, and delivered to respective members, comprising the steps of:

a. operating an overall production line printing press assembly having transition locales to perform different functions;

b. feeding polyvinyl chloride stock of a designated width and designated length through this printing press assembly;

c. printing information at spaced locations on the polyvinyl chloride stock;

d. creating pin feed holes continuously along each side of the polyvinyl chloride stock;

e. creating perforations in the polyvinyl chloride stock which are spaced from the pin feed holes on each side and extend parallel to these respective pin feed holes;

f. creating perforations at spaced transverse locations on the polyvinyl chloride stock which extend between the respective perforations located along each side of the polyvinyl chloride stock and extend beyond them across the polyvinyl chloride stock, being fed through this printing press assembly, thereby determining the area size of each membership card mailer;

g. creating microperforations extending both longitudinally and transversely at spaced locations within each membership card mailer area of the polyvinyl chloride to commence the creation of a membership card;

h. coating a portion of the membership card being created with a N.C.R. type clear copy matte coating;

i. collecting the processed polyvinyl chloride stock as so modified by the printing, perforating, and matting;

j. operating an overall production line printing press assembly having transition locales to perform different functions;

k. feeding paper stock of a designated width and designated length through this printing press assembly;

l. printing information at spaced locations on the paper stock, including printing spaced blackout portions to later match the locations of the matte coating;

m. die cutting the processed paper stock into individual paper overlays containing the printed information and blackout area.

n. collecting the processed paper stock as so modified by the printing and die cutting into stacks of individual finished overlays;

o. operating a Ga-Vehren tip on machine to receive both the processed polyvinyl chloride stock and the individual paper overlays, and during operations of this machine:

i. creating spaced borders of adhesive on the processed polyvinyl chloride stock portions which are the size of the paper overlays; and ii. affixing paper overlays to the processed polyvinyl chloride stock portions by utilizing the spaced borders of adhesive.

7. A method of making fan foldable membership card mailers, as supplied by a manufacturer to an organization, thereafter to be completed, separated, and delivered to respective members, as claimed in claim 6, comprising in addition, the step of:

fan folding affixed paper overlays and processed polyvinyl chloride stock creating the folds between the membership card mailers being created along the transverse perforations, for subsequent completion by an organization.

8. A method of making fan foldable membership card mailers, as claimed in claim 7, comprising the additional step of perforating the paper stock, including making a short continuous cut, to create an easily removable portion of each overlay to gain access to a membership card.

* * * * *